US005759061A

United States Patent [19]

Jensen et al.

[11] Patent Number: 5,759,061

[45] Date of Patent: Jun. 2, 1998

[54] IDC HAVING WIRE SLIPPAGE CONTROL

[75] Inventors: Michael Lind Jensen; John Ervin Francis, both of Raleigh; Eric Kelly Vann, Selma, all of N.C.

[73] Assignee: Raychem Corporation, Menlo Park, Calif.

[21] Appl. No.: 698,498

[22] Filed: Aug. 15, 1996

[51] Int. Cl.[6] ..... H01R 4/24

[52] U.S. Cl. ..... 439/402; 439/400

[58] Field of Search ..... 439/402, 395, 439/396, 398, 400, 403, 404, 405, 417

[56] References Cited

U.S. PATENT DOCUMENTS 4,002,391 1/1977 Dunn et al. ..... 439/403
5,176,534 1/1993 Nozick ..... 439/402
5,423,694 6/1995 Jensen et al. ..... 439/417

FOREIGN PATENT DOCUMENTS 3913842 10/1990 Germany ..... 439/395

*Primary Examiner*—Gary F. Paumen
*Assistant Examiner*—Tho Dac Ta
*Attorney, Agent, or Firm*—Herbert G. Burkard

[57] ABSTRACT

An (IDC) (10) includes a first pair of arms (12*a* and *b*) depending from a bridge (14) and defining a first conductive slot (15) for receiving an insulated wire, displacing the insulation thereon, and completing an electrical connection thereto. A detent (20) depending from one of the arms forms a narrower passage (23) for retaining a wire in the slot. A similar detent (40) in the slot (35) of a second pair of arms (32*a* and *b*) is farther from the bridge (14) than the detent (20) in the first slot (15).

12 Claims, 1 Drawing Sheet

IDC HAVING WIRE SLIPPAGE CONTROL

BACKGROUND OF THE INVENTION

The present invention relates to insulation displacement contact (IDC's), and more particularly to an improved IDC having means for controlling slippage of a wire terminated therein when the wire is subjected to small movements.

IDC's have been around for a long time and are very popular. This popularity is due in part to their ease of use, economy, versatility, and effectiveness. For many applications, IDC designs have reached a state of considerable refinement.

One area, however, which could stand improvement has to do with making IDC blades more robust for maintaining a durable and reliable connection to wires that may be subjected to small movements while in the installed or terminated position in the IDC. Prior art solutions have typically relied upon restraining means apart from the IDC, rather than the IDC itself, but this can involve additional structure which in turn causes additional costs.

A need therefore remains for IDC blades and associated methods that are inherently resistant to wire slippage of a wire terminated therein.

SUMMARY OF THE INVENTION

Briefly, the present invention meets the above needs and purposes with a new and improved insulation displacement contact, and in particular such an insulation displacement contact in which its wire-receiving slot has a unique detent provision for retaining a wire therein after the wire has been pushed into the slot. In the preferred embodiment, the detent is a boss which intrudes into the slot to form a narrower passage in the slot at that location. The boss is preferably formed by stamping followed by coining, although the process which is chosen will depend upon the desired IDC dimensions, the thickness of the metal plate from which the IDC is formed, and so forth. In this case, a bump is first formed by stamping, and then enlarged by punch coining to the desired dimension. (Punch coining refers to coining by striking with a defined punch geometry.)

In use, the insulated wire is then pushed into this slot, causing the insulation thereon to be displaced and completing an electrical connection to the IDC. As the wire is progressively pushed farther into this slot, it is forced past the detent. This results in a more stable and reliable termination for the wire since it will now not easily escape from the slot if subsequently subjected to small movements.

Preferably, when the IDC has multiple wire terminating slots, the detents are staggered so that wires which are being simultaneously terminated in the slots will progressively encounter the detents, one at a time, to make insertion and removal of the wires easier.

It is therefore an object of the present invention to provide new and improved methods and apparatus for insulation displacing contacts, wherein the insulation displacement contact includes a bridge, a pair of adjacent arms depending from the bridge and defining therebetween a conductive slot configured for receiving an insulated wire, for displacing the insulation thereon, and for completing an electrical connection thereto, and wherein at least one detent in the slot depends from at least one of the arms for retaining a wire therein after being pushed into the slot past the detent; in which the detent may include a boss intruding into the slot to form a narrower passage in the slot in the vicinity of the boss; in which the boss may include a bump formed by stamping; in which the boss may include a bump formed by stamping followed by coining; in which the boss may be a bump formed by coining; in which the boss may be a bump formed by punch coining; in which the contact may include a second pair of adjacent arms depending from the bridge and defining therebetween a second conductive slot configured for receiving an insulated wire, displacing the insulation thereon, and completing an electrical connection thereto, and having at least one detent in the second slot depending from at least one of the arms thereof for retaining a wire in the second slot after being pushed into the slot past the detent, at least one detent in the second slot being farther from the bridge than a detent in another slot in the contact; wherein an insulated wire can be received, the insulation thereon displaced, and an electrical connection thereto completed, by inserting the wire into a conductive slot in an insulation displacing connector having a bridge and a pair of adjacent arms depending from the bridge and defining therebetween the conductive slot, the slot being configured for displacing the insulation and completing the electrical connection, and pushing the wire into the slot past at least one detent depending in the slot from at least one of the arms for retaining the wire in the slot after being pushed into the slot past the detent; which may include pushing the wire into the slot past a detent which is a boss intruding into the slot to form a narrower passage in the slot in the vicinity of the boss; which may include pushing the wire into the slot past a detent which is a bump formed by stamping; which may include pushing the wire into the slot past a detent which is a bump formed by stamping followed by coining; which may include pushing the wire into the slot past a detent which is a bump formed by coining; which may include pushing the wire into the slot past a detent which is a bump formed by punch coining; which may include inserting a second wire into a second conductive slot defined by a second pair of adjacent arms depending from the bridge, the second slot being configured for displacing the insulation and completing the electrical connection, and pushing the second wire into the second slot past at least one detent depending in the slot from at least one of the arms thereof for retaining the wire in the second slot after being pushed into the slot past the detent, at least one detent in the second slot being farther from the bridge than a detent in another slot in the contact; and to accomplish the above objects and purposes in an inexpensive, uncomplicated, durable, versatile, and reliable method and apparatus, inexpensive to manufacture, and readily suited to the widest possible utilization in wire termination applications.

These and other objects and advantages of the invention will be apparent from the following description, the accompanying drawings, and the appended claims.

DESCRIPTION OF THE PREFERRED EMBODIMENTS

Figure 1:
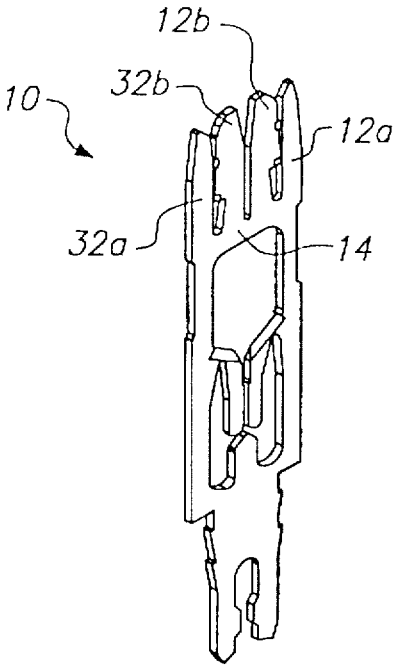
FIG. 1 is an isometric illustration of an insulation displacement contact having wire slippage and movement control according to the invention
Figure 2:
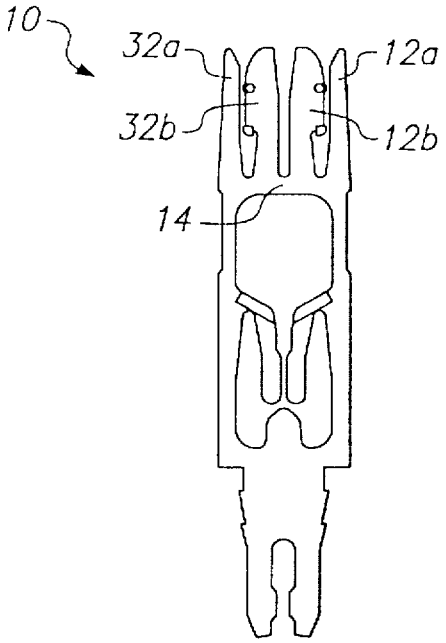
FIG. 2 is an elevation of the FIG. 1 contact.
Figure 3:
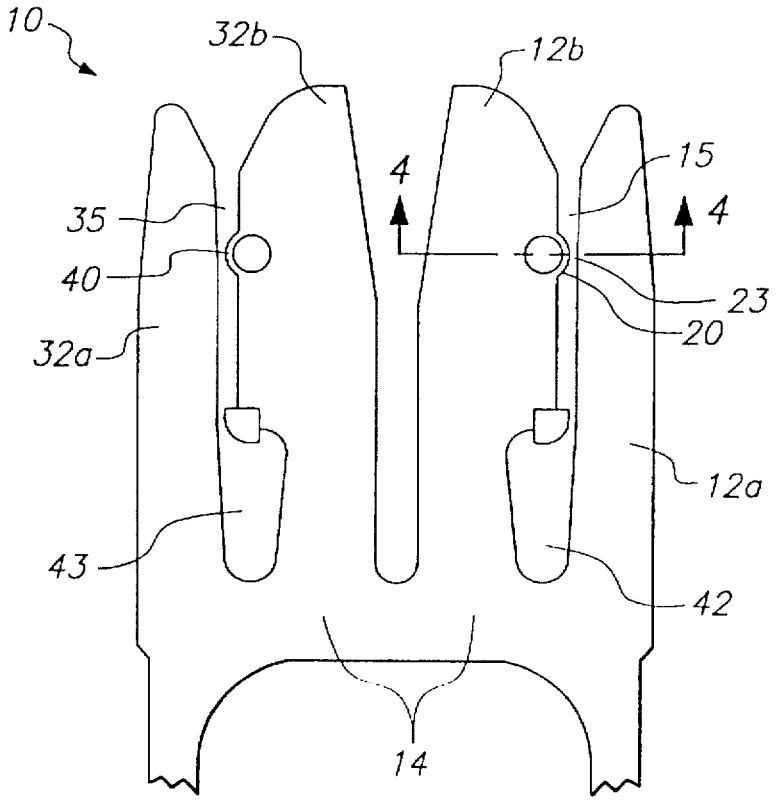
FIG. 3 is an enlarged fragment of the connector of FIGS. 1 and 2.
Figure 4:
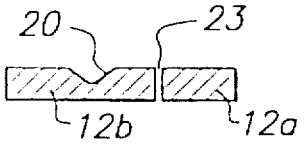
FIG. 4 is a cross-sectional view taken on line 4—4 in FIG. 3.

With reference to the drawings, the new and improved insulation displacement contact having wire slippage and movement control, and the method therefor according to the present invention, will now be described. FIG. 1 is an isometric illustration of such an insulation displacement contact 10. As shown therein, contact 10 includes a pair of arms 12*a* and 12*b* depending from a bridge 14. Arms 12 thus define a conductive slot 15 configured for receiving an insulated wire (not shown), displacing the wire's insulation, and completing an electrical connection thereto. In the preferred embodiment, the IDC 10 is formed by stamping from a sheet of copper alloy metal.

In slot 15, and depending from either arm (in this case, arm 12*b*), is a detent 20 for retaining a wire in slot 15 after the wire is pushed into the slot past the detent 20. In the preferred embodiment, detent 20 is a boss which intrudes into the slot to form a narrower passage 23 in the vicinity of the boss 20. The boss can be formed by any conventional process, depending upon the dimensions and preferred characteristics. These include stamping, coining, punch coining, or any combination thereof.

The particular IDC configuration illustrated herein is an improvement on the IDC shown in U.S. Pat. No. 5,423,694, issued Jun. 13, 1995, and assigned to the assignee of the present invention. The disclosure of U.S. Pat. 5,423,694 is therefore incorporated herein by reference for all purposes. That '694 patent shows an IDC having multiple slots for simultaneously terminating several wires, preferably one per slot. Accordingly, the present invention includes a second pair of arms 32*a* and *b* also depending from bridge 14 to define a slot 35 similar to slot 15. Slot 35 includes a detent 40 similar to detent 20, except that detent 40 is farther from bridge 14 than detent 20. This staggers the detents to reduce insertion and removal forces, particularly when used in a terminal block such as shown in the '694 patent.

Near the bridge, 14 at the base of the arms 12 and 32, will be seen respective larger open areas 42 and 43. These are beneath the slots 15 and 35, and are not part of the active IDC slot area. Rather, they are for the purpose of narrowing the bases of the arms 12 and 32 to make them more resilient so that the IDC's can better accommodate multiple wire gauges, as desired. When used with a terminal block such as shown in the '694 patent, the block prevents the wires from falling through to open areas 42 and 43, and instead retains the wires in the slots below the detents 20 and 40.

As may be seen, therefore, the present invention provides numerous advantages. Principally, it provides added security for keeping a terminated wire in the slot when the wire is subjected to small vibrations and/or movements. For example, when used in a terminal block such as shown in the '694 patent, it is intended that the block may be manipulated from time to time to, for example, add additional wires thereto. At such time, previously installed wires may be subjected to movement during this installation process. Preferably, these wires would remain terminated in their IDC slots. With the present invention, this is much more reliably assured, since minor wire movement will now not generate sufficient force to move the wire back past the detent where it might then exit from the slot. Another advantage of the invention results from the staggered spacing of the detents within their slots, so that the wires progressively encounter the detents, thus reducing insertion and removal force. The invention thus provides a straightforward, economical, robust, and highly effective solution for assuring that a wire which is terminated in the IDC will remain in the IDC until a definite decision is made to remove it.

Of course, various modifications to the present invention will occur to those skilled in the art upon reading the present disclosure, and such are intended to be included in the scope of the claims as appropriate to the language and intent thereof.

Claim dependencies have been drafted to comply with PCT Rule 6.4, but it will be understood that, at least by virtue of this paragraph, any appropriate combination of the features disclosed and/or claimed herein is in itself an embodiment of the invention, and it is intended to use multiple dependent claims in the national phase where permitted.

Therefore, while the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. An insulation displacement contact comprising:

a) a bridge, b) a first pair of adjacent arms depending from said bridge and defining therebetween a first conductive slot having a vertical longitudinal axis that intersects the bridge and configured for receiving an insulated wire, displacing the insulation thereon, and completing an electrical connection thereto, and c) at least one detent formed in said first slot on at least one of said first pair of arms for retaining a wire therein after being pushed into said first slot past said detent d) a second pair of adjacent arms depending from said bridge and defining therebetween a second conductive slot having a vertical longitudinal axis that intersects the bridge and configured for receiving an insulated wire, displacing the insulation thereon, and completing an electrical connection thereto, and e) a detent formed in said second slot on said second pair of arms thereof for retaining a wire in said second slot after being pusher into said second slot past said detent, said detent in said second slot being positioned a greater vertical distance from said bridge along the vertical longitudinal axis than the detent in the first slot of the contact.

2. The contact of claim 1 wherein said detent further comprises a boss intruding into said slot to form a narrower passage in said slot in the vicinity of said boss.

3. The contact of claim 2 wherein said boss further comprises a bump formed by stamping.

4. The contact of claim 3 wherein said boss further comprises a bump formed by stamping followed by coining.

5. The contact of claim 2 wherein said boss further comprises a bump formed by coining.

6. The contact of claim 5 wherein said boss further comprises a bump formed by punch coining.

7. A method for receiving an insulated wire, displacing the insulation thereon, and completing an electrical connection thereto, and a) inserting a first wire into a first conductive slot in an insulation displacement contact having a bridge and a first pair of adjacent arms depending from the bridge and defining therebetween the first conductive slot, which extends along a vertical longitudinal axis that intersects the bridge, the first slot being configured for displacing the insulation and completing the electrical connection, b) pushing the first wire into the first slot past at least one detent depending in the first slot from at least one of the first pair of adjacent arms for retaining the first wire in the first slot after being pushed into first slot past the detent;

c) inserting a second wire into a second conductive slot that extends along a vertical longitudinal axis that intersects the bridge and is formed by a second pair of adjacent arms depending from the bridge, and d) pushing the second wire into the second slot past at least one detent formed in the second slot on at least one of the second pair of adjacent arms thereof for retaining the second wire in the second slot after being pushed into the second slot past the detent, at least one detent in the second slot being positioned a greater vertical distance from the bridge along the longitudinal axis than the vertical distance of the detent formed in the first slot.

8. The method of claim 7 further comprising pushing the wire into the slot past a detent which is a boss intruding into the slot to form a narrower passage in the slot in the vicinity the boss.

9. The method of claim 8 further comprising pushing the wire into the slot past a detent which is a bump formed by stamping.

10. The method of claim 9 further comprising pushing the wire into the slot past a detent which is a bump formed by stamping followed by coining.

11. The method of claim 8 further comprising pushing the wire into the slot past a detent which is a bump formed by coining.

12. The method of claim 11 further comprising pushing the wire into the slot past a detent which is a bump formed by punch coining.

* * * * *

UNITED STATES PATENT AND TRADEMARK OFFICE

CERTIFICATE OF CORRECTION

PATENT NO. : 5,759,061
DATED : June 2, 1998
INVENTOR(S) : Jensen, et al

It is certified that error appears in the above-identified patent and that said Letters Patent is hereby corrected as shown below:

On the title page, item [56] Reference Cited, insert the following:

U.S. PATENT DOCUMENTS

| | | | | |
|---|---|---|---|---|
| 3,227,991 | 01/04/66 | Zdanis | 339 | 98 |
| 4,029,384 | 06/14/77 | Reinwall, Jr. | H01R9 | 08 |
| 4,735,574 | 04/05/88 | Beaulieu et al. | H01R11 | 04 |
| 5,176,534 | 01/05/93 | Nozick | H01R4 | 24 |
| | | | | |
| | | | | |
| | | | | |
| | | | | |

UNITED STATES PATENT AND TRADEMARK OFFICE

CERTIFICATE OF CORRECTION

PATENT NO. : 5,759,061
DATED : June 2, 1998
INVENTOR(S) : Jensen, et al

It is certified that error appears in the above-identified patent and that said Letters Patent is hereby corrected as shown below:

FOREIGN PATENT DOCUMENTS

| | | | | | |
|---|---|---|---|---|---|
| 0 315 345 A2 | 21.10.88 | EP | H01R4 | 24 | |
| 0 383 135 A1 | 05.02.90 | EP | H01R4 | 24 | |
| | | | | | |
| | | | | | |

Signed and Sealed this

Third Day of November, 1998

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,759,061

INVENTOR(S) : Jensen et al.

DATED : Jun. 2, 1998

It is certified that error appears in the above-identified patent and that said Letters Patent is hereby corrected as shown below:

Column 4, Line 37 replace "pusher" by -- pushed --
Column 4, Line 55 replace "and" by -- comprising --

Signed and Sealed this

Thirteenth Day of April, 1999

*Attest:*

Q. TODD DICKINSON

*Attesting Officer*

*Acting Commissioner of Patents and Trademarks*